US005852797A

United States Patent [19]

Bovay et al.

[11] Patent Number: 5,852,797

[45] Date of Patent: Dec. 22, 1998

[54] SECURE ELECTRONIC CHRONOMETRY DEVICE

[75] Inventors: Jean-Pierre Bovay, Bienne; Silvio Chianese, Evilard, both of Switzerland

[73] Assignee: Omega Electronics S.A., Bienne, Switzerland

[21] Appl. No.: 891,329

[22] Filed: Jul. 10, 1997

[30] Foreign Application Priority Data

Jul. 11, 1996 [CH] Switzerland ..... 1741/96

[51] Int. Cl.[6] ..... G44F 7/06

[52] U.S. Cl. ..... 702/178; 377/5; 340/323 R; 368/3

[58] Field of Search ..... 364/565, 561, 364/569, 410, 411, 710.14; 377/24.2, 5, 20, 24; 340/323 R, 309.15; 368/89, 113, 251, 3, 9, 10, 107; 482/3; 702/176, 178

[56] References Cited

U.S. PATENT DOCUMENTS

| | | | |
|---|---|---|---|
| 3,781,529 | 12/1973 | Abramson et al. | 377/5 |
| 4,142,680 | 3/1979 | Oswald et al. | 377/4 |
| 4,451,896 | 5/1984 | Pomerleau et al. | 364/569 |
| 5,526,290 | 6/1996 | Kanzaki | 364/565 |

FOREIGN PATENT DOCUMENTS

| | | |
|---|---|---|
| 2 698 987 | 6/1994 | France . |
| 2 725 633 | 4/1996 | France . |
| 43 19 757 | 7/1994 | Germany . |
| 1 592 442 | 7/1981 | United Kingdom . |

OTHER PUBLICATIONS

Journal Suisse D'Horlogerie et de Bijouterie, No. 1, Dec. 1984, Lausanne Ch, p. 4 XP002029252 "Chronometres <<intelligentS>>".

Uhren Juwelen Schmuck, No. 1, 20 Jan. 1981, Bielefeld De, p. 42, XP002029253 "Das Zeitmesssystem der alpinen Skiwettkampfe".

*Primary Examiner*—Louis M. Arana
*Assistant Examiner*—Craig Steven Miller
*Attorney, Agent, or Firm*—Griffin, Butler, Whisenhunt & Szipl, LLP

[57] ABSTRACT

The electronic chronometry device (D) comprises an acquisition cell (2) arranged to receive time data (6) coming from at least one time events measurement sensor (8), a storing unit (9) for storing said time data (6), and a processing unit (4) of said time data (6) and associated with said acquisition cell (2). This device is characterized in that said storing unit (9) is associated with an interface (1) which is arranged so as to allow said processing unit (4) to access said storing unit (9) and to read certain of said time data (6) stored in said storing unit (9) without allowing modification of said storing unit (9) by said processing unit (4).

3 Claims, 1 Drawing Sheet

SECURE ELECTRONIC CHRONOMETRY DEVICE

The present invention concerns an electronic chronometry device for measuring the time obtained by participants during sportive events, and more specifically such a device which is associated to an information processing system so as to improve the processing of data as well as the presentation of the results thus obtained.

Sports chronometry is usually performed using an electronic chronograph printer. These apparatus consists of a timepiece base, of a counter, of memory storing means comprising the events' journal, of a calculation and a chornographic information processing unit, of a display and of a printer. These apparatus are connected to time sensors by way of input interfaces and to information media by way of output inferfaces. These apparatus may be provided with interchangeable application modules which are dedicated to different sports. This technique guarantees an efficient security for all the recorded and calculated times.

On the contrary, this technique is limited by its application flexibility, by the global vision of the sports events which is to be controlled and by the operation power, despite the interchangeable application modules which remain static and which are difficult to reprogram, which is harmful to the flexibility.

Electronic chronometry devices are already known which are connected to microcomputer such as a PC acting as the data processor, see for example the document FR-A-2 698 987. Thus, it is possible to work with alphanumerical information for establishing departure lists, results lists and statistical lists. It is further possible to modify the results as a function of weighing factors which are defined by the rules of the competition.

However, such devices cannot operate in real time, which is an important limitation with respect to the direct information which is demanded by the media and the sportsmen. Furthermore, these devices are neither economical, nor optimally managed, because they require an operator for each apparatus.

To overcome these inconveniences, two solutions have already been proposed. On the one hand, it is possible to integrate the chronometric program into the computer itself, which then becomes a full measurement apparatus, and on the other hand, it is possible to integrate the computer circuit into a chronometry apparatus. However, in these two cases, besides the specific inconveniences due to the evolution of information technology and to the material adaptment in the field, the measured times are no longer protected against exterior aggressions on the measurement system. Indeed, as soon as a chronometric information is stored even momentarily in a RAM, this information is vulnerable, despite the presence of coding means. A chronometrical data is easily modified across an information network or with a cunning operator.

Thus an object of the present invention is to remedy these defaults by presenting an electronic chronometry device for time measurements which is very flexible and which allows an improved visual representation of the results, but which is nevertheless completely protected from manipulations which could corrupt the chronometrical data and the events journal comprising these data.

To this effect, the invention has as object an electronic chronometry device comprising:

an acquisition cell arranged to receive time data coming from at least one time events measuring sensor, a storing unit for storing said time data, and a processing unit for processing said time data and which is associated with said acquisition cell, said device being characterized in that said storing unit is associated with an interface which is arranged in such a way as to allow said processing unit to access said storing unit and to read certain of said time data which are stored in said storing unit without allowing a modification of said storing unit by said processing unit.

Thanks to this intelligent interface, the device according to the invention thus allows to protect the data coming from the closed world of sports chronometry for communication with the open environment of the information world so as to improve and to facilitate the visualisation of the results.

An embodiment of the object of the invention will be described hereafter by way of example only by referring to the attached drawings in which.

Figure 1:
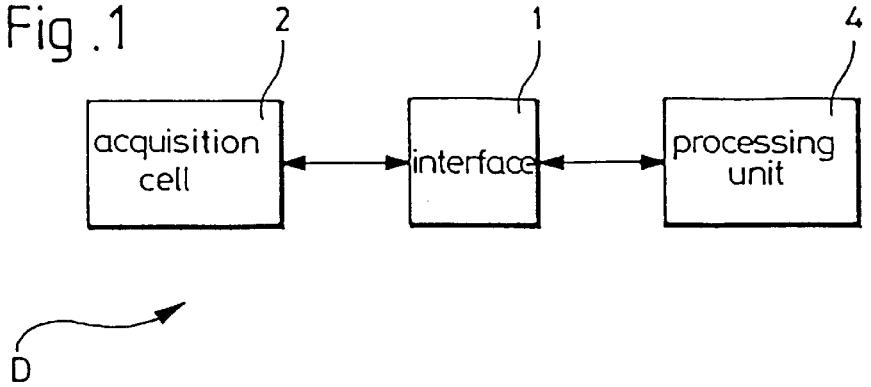
FIG. 1 represents schematically the electronic chronometry device according to the invention.

FIG. 1 shows schematically an electronic chronometry device according to the invention designated by the general reference D. Device D comprises an acquisition cell 2 of time data which can communicate by way of an interface 1 with a processing unit 4 of these data, this unit 4 may a programmable unit, for example a microcomputer or a PC. Interface 1 allows the dialogue between the acquisition cell 2 and the data processing unit 4 as will be explained in more detail hereafter.

Figure 2:
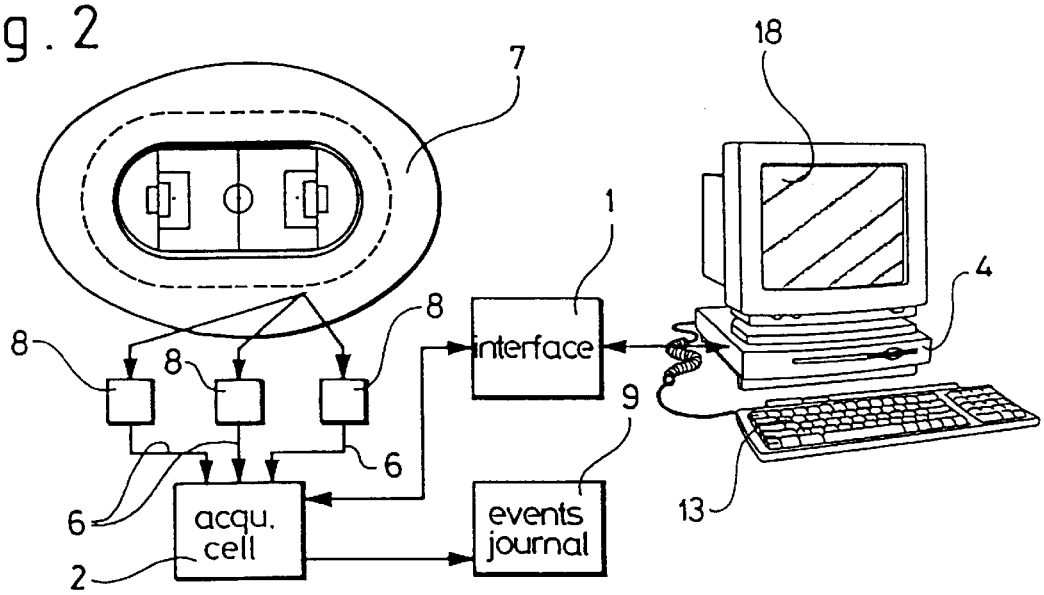
FIG. 2 shows in more detail the device of FIG. 1.

Reference will now be made to FIG. 2. The role of the acquisition cell 2 corresponds to that of a classical electronic chronograph and is thus to acquire the times coming from the different chronometry sensors 8 during a sports event 7. To this effect, acquisition cell 2 comprises, in a manner known as such, a data input interface and a data output interface (non-represented), a timebase (non-represented), a storing unit which is called the events journal 9 for memorising the time data 6 coming from sensors 8 which are arranged so as to detect the sports event 7 which takes place, an output buffer memory and a pilot printer (non-represented) recording all chronographic pulses provided by sensors 8 in real time and in chronological order before any processing.

Processing unit 4 is in itself incapable of performing the chronometry of a sports competition. This unit is associated by way of a classical connection, for example a bidirectional RS-232 cable, to acquisition cell 2 for allowing a desired presentation and/or visualisation.

An operator of processing unit 4 may send for example by way of a keyboard 13, commands or instructions to acquisition cell 2 to instruct it to transmit the time data which is necessary to calculate the race time and needed for the desired visualisation.

Advantageously, there is provided an application program which is dedicated to a certain sport to be commanded by processing unit 4. This program may be arranged in such a way as to manage a dialogue between cell 2 and processing unit or PC 4 and to prepare the received time data 6 for the intended visualisation.

According to the invention, it is possible to protect the time data 6 coming from sensors 8 from external influences which might corrupt the chronologic information. This is why processing unit 4 is not directly connected to acquisition cell 2, but by way of interface Indeed, interface 1 allows the dialogue between processing unit 4 and acquisition cell 2, and more precisely between this unit 4 and the storing unit or events journal 9. To this effect, interface 1 is arranged in such a way as to allow a certain level of authorisation access to data stored in the journal 9 so as to avoid that a non-authorised third may read and/or copy these time data 6. This interface thus ensures a locking of the information, and this interface may be obtained for example by way of a protection software which requires a password before releasing the transfer of time data 6 from acquisition cell 2 towards processing unit 4. Each time that interface 1 receives a correct password from processing unit 4, the interrogation of the journal 9 by the processing unit is authorised. According to the invention, no modification at all of the journal 9 is allowed, only a reading authorisation of the journal may be provided by interface 1.

Preferably, processing unit 4 is constituted by way of a programmable computer which is arranged in such a way as to load an operating software into acquisition cell 2, this software being dependent on the sports event 7 which is to monitored by interface 1. This operation software may be used to manage the way of storing the different time data 6 received from sensors 8 in predetermined places or memories of storing unit 9. Thus, the adaptation of acquisition cell 2 to the event 7 to be monitored may be facilitated thanks to an operation software dedicated to this event.

The functioning of the chronometric device D according to the invention will be explained hereafter with the help of FIG. 3 which shows schematically a function-time diagram of device D.

Figure 3:
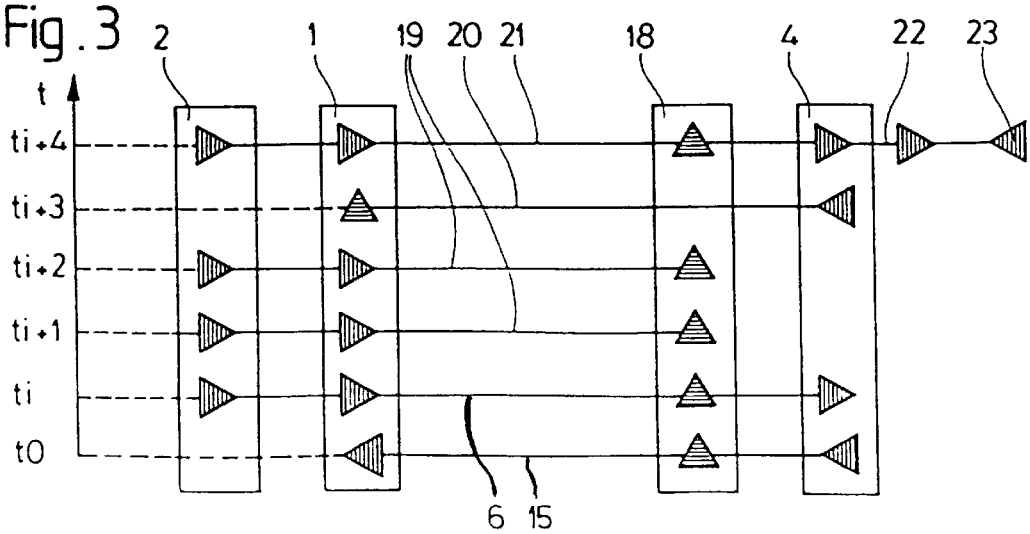
FIG. 3 represents schematically a function-time diagram of the device according to the invention.

The vertical axis of FIG. 3 represents the time starting at an instant $t_0$, and the horizontal axis shows the different instructions and time data which pass through the different components of the device D according to the invention.

Firstly, the operator of processing unit 4 may send an instruction 15 comprising a password, or an identification code, to interface 1 for establishing the dialogue with acquisition cell 2 and, possibly, for then allowing the charging of an operation software for acquisition cell 2 so as to initialise this cell 2 and to start the chronometry. In a way which is known as such, processing unit 4 further comprises a monitor or screen 18 on which the different operations are visualised. Acquisition cell 2 is thus ready to transmit the time data 6 towards processing unit 4. Instruction 15 may also comprise an order from the operator for sending only certain time data 6 which are intended for the desired calculation.

At instant $t_i$, the first of the time data 6, the one which corresponds to the departure instant, comes from sensor 8 and is captured by acquisition cell 2. This data is stored in storing unit 9 and is printed on the pilot printer, non-represented. As interface 1 establishes a connection between cell 2 and processing unit 4, this data 6 is immediately transmitted, at instant $t_i$ to processing unit 4 which visualies it on its screen 18. From that moment on, this received data is considered valid and it is available for any successive processing by the operator of processing unit 4.

Then, at instant $t_{i+1}$, a parasite data 19 is captured by sensor 8. This data 19 may for example be created by a referee or a bird passing in front of the sensor. Naturally, this passage is detected in a normal manner and the time data is transmitted towards processing unit 4. This parasite data 19 is also visualised on screen 18 and stored in the events journal 9 for a control of all the detected data. However, this data will not be accepted as being a valid data according to the used operation system which normal only accepts data received within a predetermined time window. Parasite data 19 is thus not available for a processing by the operator, but it is possible to allow for an a-posteriori validation of such a data if this data turns out to be correct afterall. Such processing and/or validation of the parasite data is known to the skilled person and will not be described in further detail here.

At instant $t_{i+2}$, a second parasite data 19 is also visualised on screen 18 and stored in the journal 9, but it is not taken into consideration either if it does not arrive within the allowed time and it is thus also not available within processing unit 4.

Thus, at instant $t_{i+3}$, the operator may send, also in a manner known as such, an cancellation instruction 20 to interface 1 to invalid the reception of this parasite data 19 and to ask interface 1 to transmit the next data which it has received. This data, referenced 21 in FIG. 3, arrives at instant $t_{i+4}$ in interface 1 and is thus transmitted towards programmable unit 4, where it is visualised on screen 18 and taken into consideration by processing unit 4 for the calculation of the race time. This calculation result, referenced 22 in FIG. 3, is then sent towards the outer world which may be an information data network.

It may thus be understood that the data are stored in a storing unit, or events journal 9, and are printed before any processing. Any successive processing can only modify the presentation of the visualisation of this data, but it cannot modify the journal 9 itself, because this journal 9 has a limited authorization access. Acquisition cell 2 cannot classify or process the data itself, this being managed by the operation software which has been loaded before hand by processing unit 4.

Thanks to the separation of processing unit 4 and of storing unit or event journal 9 and thanks to the limited access of the latter, an instruction 23 coming from the outside network can in no case alter this journal 9 of interface 1 due to an insufficient authorization of access and because it has no possibility to modify the content of the storing unit.

Naturally, the electronic chronometry device which is described hereabove may undergo several modifications and may be presented in other embodiments which are obvious to the skilled person without departing from the scope of the present invention.

What is claimed is:

1. An electronic chronometry device comprising an acquisition cell arranged to receive time data coming from at least one time events measuring sensor, a storing unit for storing said time data, and a processing unit for processing said time data and which is associated with said acquisition cell, wherein said storage unit is associated with an interface which is arranged in such a way as to allow said processing unit to access said storage unit and to read certain of said time data which are stored in said storage unit without allowing modification of said storage unit by said processing unit.

2. The chronometry device according to claim 1, wherein said acquisition cell is arranged in such a way that it may receive a specific predetermined program for managing the storing of said time data in said storage unit.

3. The chronometry device according to claim 2, wherein said processing unit is arranged in such a way as to allow the loading of said program in said acquisition cell after having been allowed access by said interface.

* * * * *